US009865251B2

(12) United States Patent
Liu et al.

(10) Patent No.: US 9,865,251 B2
(45) Date of Patent: Jan. 9, 2018

(54) TEXT-TO-SPEECH METHOD AND MULTI-LINGUAL SPEECH SYNTHESIZER USING THE METHOD

(71) Applicant: ASUSTeK COMPUTER INC., Taipei (TW)

(72) Inventors: Hsun-Fu Liu, Taipei (TW); Abhishek Pandey, Taipei (TW); Chin-Cheng Hsu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 134 days.

(21) Appl. No.: 14/956,405

(22) Filed: Dec. 2, 2015

(65) Prior Publication Data

US 2017/0047060 A1 Feb. 16, 2017

(30) Foreign Application Priority Data

Jul. 21, 2015 (TW) ..... 104123585 U
Nov. 11, 2015 (TW) ..... 104137212 U

(51) Int. Cl.
*G10L 13/00* (2006.01)
*G10L 13/10* (2013.01)
(Continued)

(52) U.S. Cl.
CPC ..... *G10L 13/10* (2013.01); *G10L 13/07* (2013.01); *G10L 13/086* (2013.01); *G10L 13/00* (2013.01);
(Continued)

(58) Field of Classification Search
CPC ..... G10L 13/00; G10L 13/02; G10L 13/04; G10L 13/06; G10L 13/08; G10L 13/10
(Continued)

(56) References Cited

U.S. PATENT DOCUMENTS 5,940,797 A * 8/1999 Abe ..... G10L 13/10 704/258
2004/0193398 A1* 9/2004 Chu ..... G10L 13/08 704/3
(Continued)

FOREIGN PATENT DOCUMENTS

CN 1540626 A 10/2004
CN 102881282 A 1/2013
(Continued)

OTHER PUBLICATIONS

Wu et al., "Research of Coarticulation Process of Chinese-English speech translation system," The 9th seminal of Computational Linguistics and Chinese Language Processing, pp. 85-104, Published in the Year 1996.

*Primary Examiner* — Forrest F Tzeng
(74) *Attorney, Agent, or Firm* — CKC & Partners Co., Ltd.

(57) ABSTRACT

A text-to-speech method and a multi-lingual speech synthesizer using the method are disclosed. The multi-lingual speech synthesizer and the method executed by a processor are applied for processing a multi-lingual text message in a mixture of a first language and a second language into a multi-lingual voice message. The multi-lingual speech synthesizer comprises a storage device configured to store a first language model database, a second language model database, a broadcasting device configured to broadcast the multi-lingual voice message, and a processor, connected to the storage device and the broadcasting device, configured to execute the method disclosed herein.

14 Claims, 9 Drawing Sheets

(51) Int. Cl.

| | |
|---|---|
| ***G10L 13/08*** | (2013.01) |
| ***G10L 13/07*** | (2013.01) |
| *G10L 13/04* | (2013.01) |
| *G10L 13/02* | (2013.01) |
| *G10L 13/06* | (2013.01) |

(52) U.S. Cl.
CPC ..... *G10L 13/02* (2013.01); *G10L 13/04* (2013.01); *G10L 13/06* (2013.01); *G10L 13/08* (2013.01)

(58) Field of Classification Search
USPC ..... 704/E13.001
See application file for complete search history.

(56) References Cited

U.S. PATENT DOCUMENTS

| | | | | |
|---|---|---|---|---|
| 2006/0136216 | A1* | 6/2006 | Shen | G10L 13/08 704/266 |
| 2012/0173241 | A1* | 7/2012 | Li | G10L 13/086 704/260 |
| 2013/0132069 | A1* | 5/2013 | Wouters | G06F 17/28 704/8 |
| 2014/0114663 | A1* | 4/2014 | Lin | G10L 13/033 704/260 |

FOREIGN PATENT DOCUMENTS

| | | | |
|---|---|---|---|
| TW | I281145 | B | 5/2007 |
| TW | 201322250 | A | 6/2013 |
| TW | 201417092 | A | 5/2014 |

* cited by examiner

| | | | | | | |
|---|---|---|---|---|---|---|
| Pavg1 | 100 | 146 | 305 | 230 | 150 | 143 |
| PAU1 | 175 | 179 | 275 | 300 | 120 | 150 |
| PAU2 | 140 | 157 | 280 | 210 | 100 | 101 |
| PAU3 | 80 | 146 | 210 | 375 | 145 | 143 |
| PAU168 | 100 | 146 | 305 | 230 | 150 | 143 |
| PAU63 | 110 | 145 | 310 | 210 | 145 | 151 |
| PAU103 | 102 | 151 | 301 | 237 | 152 | 137 |

FIG. 6A

TEXT-TO-SPEECH METHOD AND MULTI-LINGUAL SPEECH SYNTHESIZER USING THE METHOD

RELATED APPLICATIONS

This application claims priority to Taiwan Application Serial Number 104123585, filed Jul. 21, 2815, and Serial Number 104137212, filed Nov. 1, 2015, the entirety of which is herein incorporated by reference.

BACKGROUND OF THE INVENTION

Field of the Invention

The present disclosure relates to a text to speech method and, more particularly, to a text to speech method and a synthesizer for processing a multi-lingual text message into a multi-lingual voice message.

Description of the Related Art

With the globalization, multiple languages are usually blended in conversation. For example, professional field terms, terminology, foreigner names, foreign geographical names, and foreign specific terms that are not easily translated, would be blended in the local language.

In general TTS (Text-To-Speech) methods are usually used for a single language, and a voice message is searched in a corresponding language database, and then converted to a voice message corresponding to the language. However, the conventional TTS cannot effectively process the text message with two or more languages, since the databases do not include the corresponding voice message with two of more language.

SUMMARY OF THE INVENTION

According to a first aspect of the present disclosure, a text-to-speech method executed by a processor for processing a multi-lingual text message in a mixture of a first language and a second language into a multi-lingual voice message, cooperated with a first language model database having a plurality of first language phoneme labels and first language cognate connection tone information and a second language model database having a plurality of second language phoneme labels and second language cognate connection tone information, comprises: separating the multi-lingual text message into at least one first language section and at least one second language section; converting the at least one first language section into at least one first language phoneme label and converting the at least one second language section into at least one second language phoneme label; looking up the first language model database using the at least one first language phoneme label thereby obtaining at least one first language phoneme label sequence, and looking up the second language database model using the at least one second language phoneme label thereby obtaining at least one second language phoneme label sequence; assembling the at least one first language phoneme label sequence and at least one second language phoneme label sequence into a multi-lingual phoneme label sequence according to an order of words in the multi-lingual text message; producing inter-lingual connection tone information at a boundary between every two immediately adjacent phoneme label sequences, wherein every two immediately adjacent phoneme label sequences includes one of the at least one first language phoneme label sequence and one of the at least one second language phoneme label sequence; combining the multi-lingual phoneme label sequence, the first language cognate connection tone information at a boundary between every two immediately adjacent phoneme label of the at least one first language phoneme label sequence, the second language cognate connection tone information at a boundary between every two immediately adjacent phoneme labels of the at least one second language phoneme label sequence, and inter-lingual connection tone information to obtain the multi-lingual voice message, and outputting the multi-lingual voice message.

Furthermore, according to a second aspect of the present disclosure, a multi-lingual speech synthesizer for processing a multi-lingual text message in a mixture of a first language and a second language into a multi-lingual voice message, comprises: a storage device configured to store a first language model database having a plurality of first language phoneme labels and first language cognate connection tone information, and a second language model database having a plurality of second language phoneme labels and second language cognate connection tone information; a broadcasting device configured to broadcast the multi-lingual voice message a processor, connected to the storage device and the broadcasting device, configured to: separate the multi-lingual text message into at least one first language section and at least one second language section; convert the at least one first language section into at least one first language phoneme label and converting the at least one second language section into at least one second language phoneme label; look up the first language model database using the at least one first language phoneme label thereby obtaining at least one first language phoneme label sequence, and look up the second language database model using the at least one second language phoneme label thereby obtaining at least one second language phoneme label sequence; assemble the at least one first language phoneme label sequence and at least one second language phoneme label sequence into a multi-lingual phoneme label sequence according to an order of words in the multi-lingual text message; produce inter-lingual connection tone information at a boundary between every two immediately adjacent phoneme label sequences, wherein every two immediately adjacent phoneme label sequences includes one of the at least one first language phoneme label sequence and one of the at least one second language phoneme label sequence; combine the multi-lingual phoneme label sequence, the first language cognate connection tone information at a boundary between every two immediately adjacent phoneme label of the at least one first language phoneme label sequence, the second language cognate connection tone information at a boundary between every two immediately adjacent phoneme labels of the at least one second language phoneme label sequence, and inter-lingual connection tone information to obtain the multi-lingual voice message, and output the multi-lingual voice message to the broadcasting device.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

BRIEF DESCRIPTION OF THE DRAWINGS

These and other features, aspects, and advantages of the present disclosure will become better understood with regard to the following description, appended claims, and accompanying drawings.

FIGS. 6A-6B illustrate the calculation of available candidates of the audio frequency data in accordance with an embodiment;

DETAILED DESCRIPTION OF THE EMBODIMENTS

The order of steps in embodiments is not used for restricting the sequence in execution. The device equivalent to the recombination of components in the disclosure is also within the scope of the disclosure.

The wording "first" and "second" and so on do not represent the order or the sequence, which are just used for distinguish terms with the same name. The terms "include", "comprise", "have" are open-ended.

Figure 1:
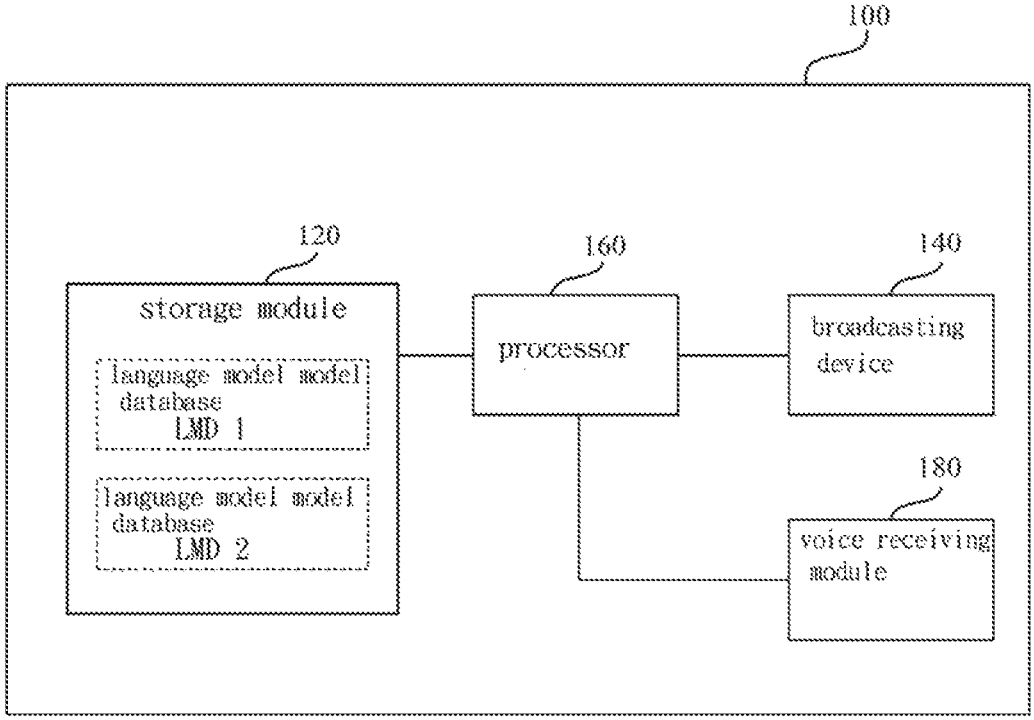
FIG. 1 is a block diagram showing a multi-lingual speech synthesizer in an embodiment.

FIG. 1 is a block diagram showing a multi-lingual speech synthesizer in accordance with an embodiment. As shown in FIG. 1, a multi-lingual speech synthesizer 100 includes a storage module 120, a broadcasting device 140, and a processor 160.

The multi-lingual speech synthesizer 100 is used for processing/converting a text message to a corresponding multi-lingual voice message, and the broadcasting device 140 outputs the multi-lingual voice message. In an embodiment, the multi-lingual speech synthesizer 100 processes a multi-lingual text message.

In an embodiment, the storage module 120 stores a plurality of language model databases, e.g., LMD1, LMD2, etc., and each of the language model databases corresponds to a single language (e.g., Mandarin, English, Japanese, German, French, Spanish). Furthermore, each of the language model databases includes a plurality of phoneme labels of a single language and cognate connection tone information. In an embodiment, the multi-lingual text message blends two languages-Mandarin and English, and the storage module 120 stores a Mandarin model database LMD1 and an English model database LMD2. However, the varieties of languages are not limited herein. A mixed multi-language model database for both Mandarin and English is not needed in an embodiment.

The phoneme label is a minimum sound unit with a distinguishable pronunciation. In an embodiment, a word or a character includes at least one syllable, and one syllable includes at least one phoneme. In an embodiment, a Mandarin character includes one syllable, and the syllable usually includes one to three phonemes (each of phonemes is similar to a pinyin symbol). In an embodiment, an English word includes at least one syllable, each syllable includes one to several phonemes (each phoneme is similar to an English phonetic symbol). In an embodiment, each language model database includes pronunciation of phonemes and connection tone information between the phonemes for a better voice effect. The connection tone information provides a tone for connecting a preceding phoneme and a succeeding phoneme when two immediately adjacent phonemes (belongs to two immediately adjacent words or characters) are pronounced.

The phoneme label is a representing-symbol facilitating the system processing. Each of the language model databases LMD1 and LMD2 further stores audio frequency data including a pitch, a tempo, timbre of each phoneme label for pronunciation. In an embodiment, the pitch includes, but not limited to, the frequency of pronunciation, the tempo includes, but not limited to, speed, interval, rhythm of the pronunciation, and the timbre includes, but not limited to, pronunciation quality, mouthing shapes, and pronunciations.

Figure 2:
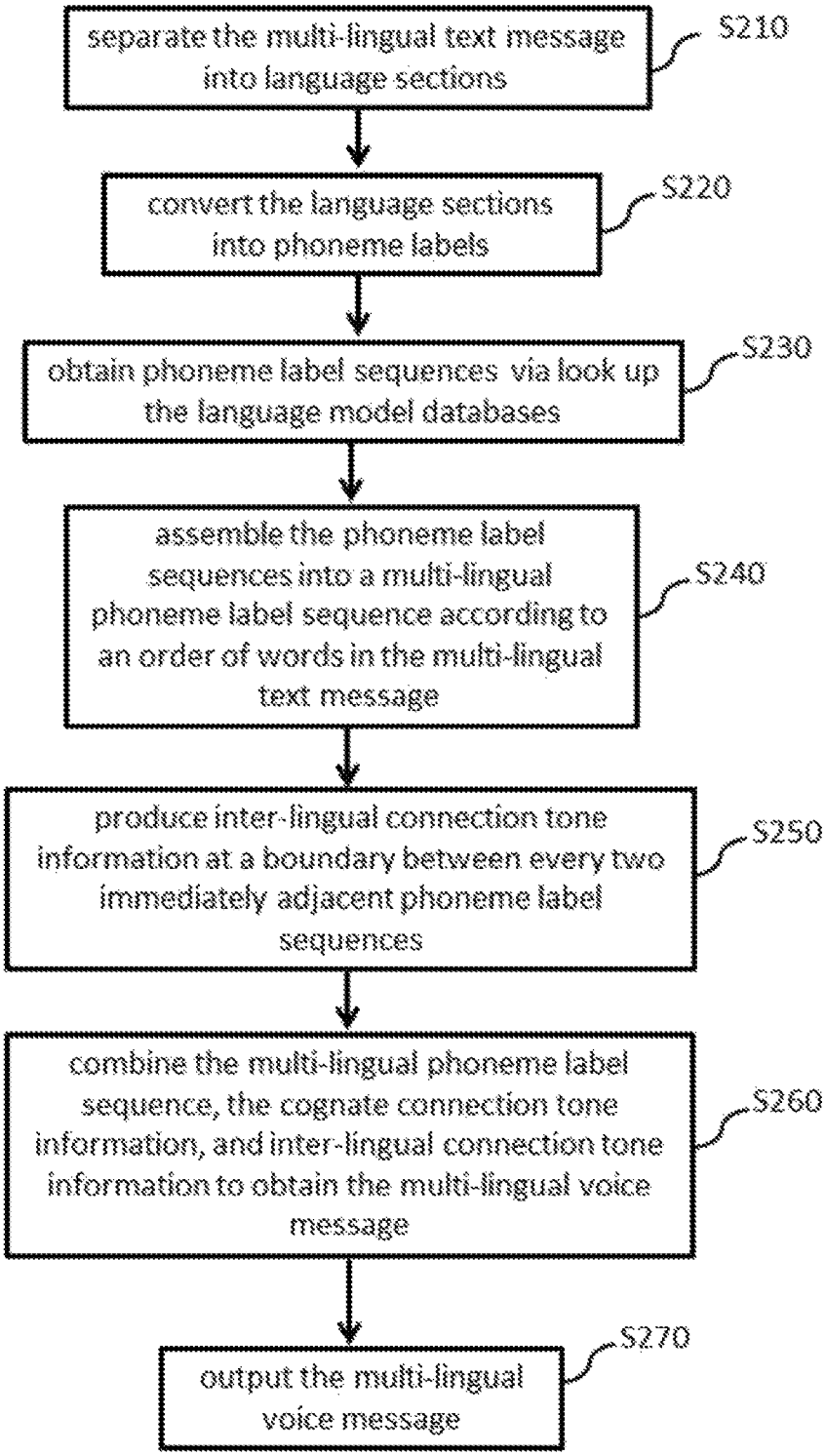
FIG. 2 is a flowchart of a text-to-speech method in accordance with an embodiment.

FIG. 2 is a flow chart showing the steps of a text-to-speech method in accordance with an embodiment. A multi-lingual text-to-speech method 200 is used for processing/converting a text message including different languages into a multi-lingual voice message. In an embodiment, the multi-lingual text-to-speech method is executed by a processor 160, such as, but not limited to, a central processing unit (CPU), a System on Chip (SoC), an application processor, an audio processor, a digital signal processor, or a controller with a specific function.

In an embodiment, the multi-lingual text message can be, but not limited to, a paragraph in an article, an input command, selected words or characters in a webpage. In an embodiment, a first language model database has a plurality of first language phoneme labels and first language cognate connection tone information, and a second language model database has a plurality of second language phoneme labels and second language cognate connection tone information.

As shown in FIG. 2, the multi-lingual text-to-speech method 200 includes the following steps. Step S210 is to separate the multi-lingual text message into at least one first language section and at least one second language section. In an embodiment, the processor 160 separates the multi-lingual text message into language sections according to different languages. In an embodiment, the text message "放個 Jason Mraz 來聽" is separated into three language sections such as "放個" (a Mandarin language section), "來聽" (a Mandarin language section), and "Jason Mraz" (an English language section).

Step S220 is to convert the at least one first language section into at least one first language phoneme label and to convert the at least one second language section into at least one second language phoneme label. In an embodiment, each phoneme label includes audio frequency data such as, but not limited to, a pitch, a tempo, timbre of phonemes.

Step S230 is to look up the first language model database LMD1 using the at least one first language phoneme label thereby obtaining at least one first language phoneme label sequence, and to look up the second language database LMD2 model using the at least one second language phoneme label thereby obtaining at least one second language phoneme label sequence.

In an embodiment, letter "M" represents phonemes of Mandarin, and the number represents the serial number of phonemes in Mandarin. In an embodiment, the Chinese character "放" corresponds to two phoneme labels [M04] and [M29], the Chinese character "個" corresponds to another two phoneme labels [M09] and [M25]. As a result, the phoneme label sequence that convened from the Mandarin language section "放個" is [M04 M29 M09 M25].

Similarly, the phoneme label sequence corresponding to the language section "來聽" is [M88 M29 M41 M44]. Moreover, the phoneme label sequence corresponding to the English language section "Jason Mraz" is [E19 E13 E37 E01 E40] according to the English model database LMD2.

Step S240 is to assemble the at least one first language phoneme label sequence and at least one second language phoneme label sequence into a multi-lingual phoneme label sequence according to an order of words (or characters) in the multi-lingual text message.

In other words, the processor 160 arranges the multiple phoneme label sequences of the different language sections according to the sequence of the original multilingual text message, and assembles the arranged phoneme label sequences into a multi-lingual phoneme label sequence. In the embodiment, the three converted phoneme label sequences of the text message "放個 Jason Mraz 來聽", i.e., [M04 M29 M09 M25], [E19 E13 E37 E01 E40], and [M04 M29 M09 M25], are assembled into a multi-lingual phoneme label sequence as [M04 M29 M09 M25 E19 E13 E37 E01 E40 M08 M29 M41 M44] according to the sequence of the original multi-lingual text message.

In step S250, the processor 160 produces inter-lingual connection tone information at a boundary between every two immediately adjacent phoneme label sequences, wherein every two immediately adjacent phoneme label sequences includes one of the at least one first language phoneme label sequence and one of the at least one second language phoneme label sequence. In an embodiment, the processor 160 looks up the language model databases LMD1 and LMD2 to obtain inter-lingual connection tone information for each two immediately adjacent phoneme labels. An embodiment of the detailed process is described hereinafter.

In step S260, the processor 160 combines the multi-lingual phoneme label sequence, the first language cognate connection torte information at a boundary between every two immediately adjacent phoneme label of the at least one first language phoneme label sequence, the second language cognate connection tone information at a boundary between every two immediately adjacent phoneme labels of the at least one second language phoneme label sequence, and inter-lingual connection tone information to obtain the multi-lingual voice message and in step S270, the multi-lingual voice message is outputted.

Figure 3:
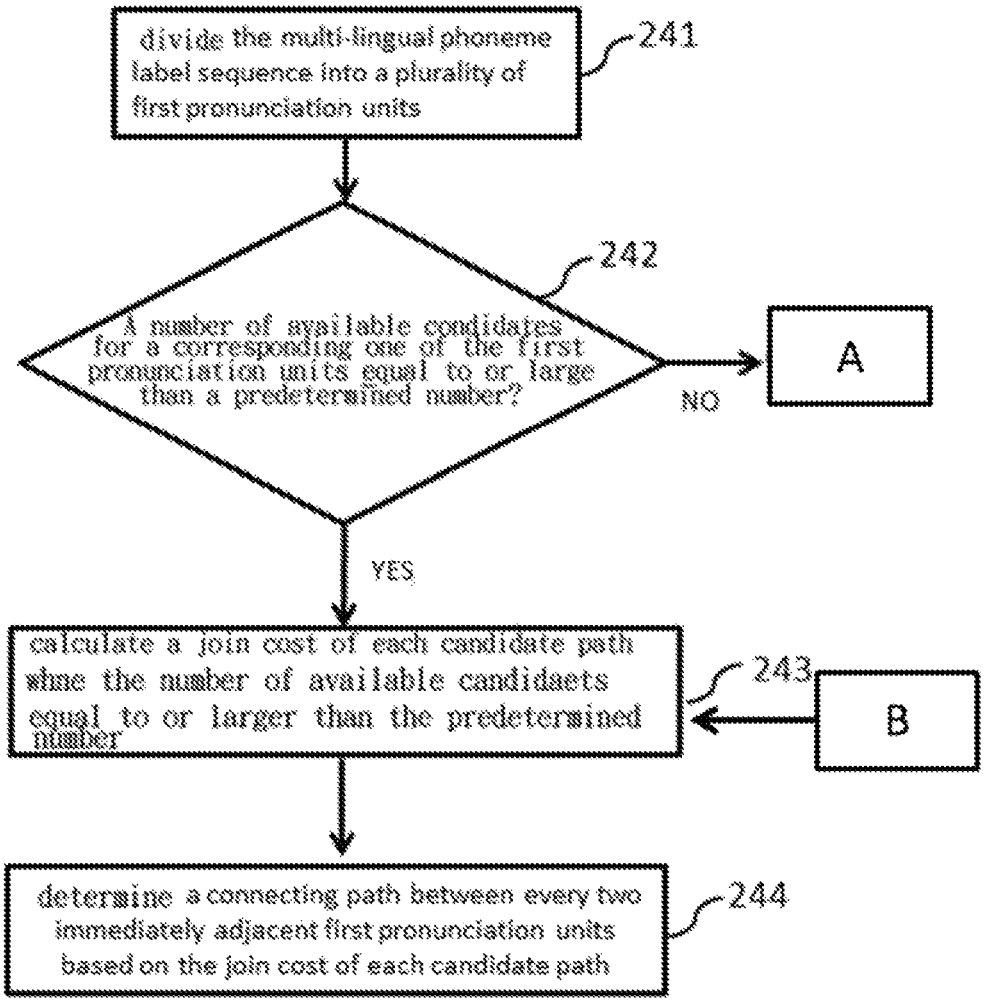
FIGS. 3 and 4 illustrate a flowchart of step S240 in accordance with an embodiment.

For better voice effect, in an embodiment, the step S240 of the text-to-speech method in FIG. 2 further includes steps S241-S245, which is as showed in FIG. 3.

As shown in FIG. 3, in S241, the processor 160 divides the assembled multi-lingual phoneme label sequence jaw a plurality of first pronunciation units, and each of the plurality of first pronunciation units is in a single language and includes consecutive phoneme labels of a corresponding one of the at least one first language phoneme label sequence and the at least one second language phoneme label sequence.

Then, step S242 is executed on each of the first pronunciation units. In step S242, the processor 160 determines whether a number of available candidates for a corresponding one of the first pronunciation units in a corresponding, one of the first language model database and the second language model database is equal to or more than a predetermined number corresponding to the one of the first pronunciation units. When the number of available candidates for each of the first pronunciation units in the corresponding one of the first language model database and the second language model database is determined equal to or more than the corresponding predetermined number, then the processor 160 executes the step S243 to calculate a join cost of each candidate path, wherein each candidate path passes through one of the available candidates of each of the first pronunciation units. In step S244, the processor 160 determines a connecting path between every two immediately adjacent first pronunciation units based on the join cost of each candidate path.

Further, in an embodiment, in the step S244 the processor 160 further determines a connecting path between a selected one of the available candidates in a front one of two immediately adjacent first pronunciation units and a selected one of the available candidates in a rear One of two immediately adjacent first pronunciation units, wherein the selected one of the available candidates in the front one of two immediately adjacent first pronunciation units and the selected one of the available candidates in the rear one of two immediately adjacent first pronunciation units are both located in one of the candidate paths that has a lowest join cost.

Figure 4:
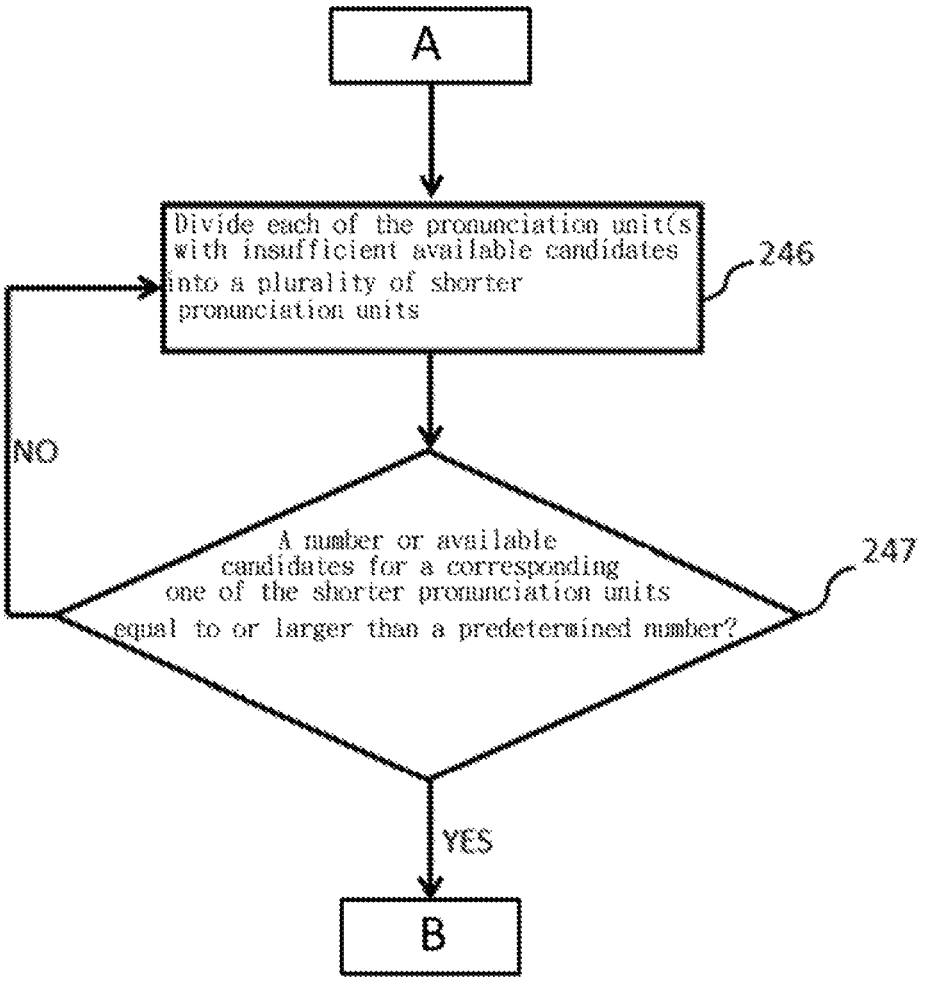

However, after step 242, when the number of available candidates for any one or one of the first pronunciation units in the corresponding one of the first language model database and the second language model database is determined to be less than the corresponding predetermined number, a subset (indicated as A in FIG. 3) of steps S246 and S247 in an embodiment as showed in FIG. 4 is proceeded.

In step S246 in FIG. 4, the processor 160 further divides the one or ones of the first pronunciation units into a plurality of second pronunciation units, a length of any one of the second pronunciation units is shorter than a length of a corresponding one of the first pronunciation units. In step S247, for each of the second pronunciation units, the processor 160 further determines whether a number of available candidates for a corresponding one of the second pronunciation units in a corresponding one of the first language model database and the second language model database is equal to or more than a predetermined number corresponding to the one of the second pronunciation units.

In other words, the subset of steps S246 and S247 is repeated if the number of available candidates for any one or ones of the first pronunciation units (or the second pronunciation units and so on.) in the corresponding one of the first language model database and the second language model database is determined to be less than the corresponding predetermined number in step 242, until the number available candidates is determined equal to or more than the corresponding predetermined number, and then a join cost of each candidate path is calculated in step 243.

In an embodiment, a multi-lingual text message "我們下個星期 一起去 Boston University 參加畢業典禮" is divided into several first pronunciation units such as audio frequency date "我們", "下個星期", "一起", "去", "Boston University", "參加畢業典禮". The processor 160 then determines whether a number of available candidates for these first pronunciation units in a corresponding one of the first language model database and the second language model database is equal to or more than a predetermined number corresponding to the one of the first pronunciation units.

In an embodiment, assuming that the predetermined number of available candidates for the first pronunciation unit "參加畢業典禮" is ten, if only five available candidates for the first pronunciation unit "參加畢業典禮" in the first language model database LMD1 are available, this means that the number of available candidates in the first language model database LMD1 is less than the corresponding predetermined number, and then second pronunciation units with a shorter length than the first pronunciation unit "參加畢業典禮" are divided from the first pronunciation unit "參加畢業典禮", as step 246 in FIG. 4.

In an embodiment, the predetermined number for each of the second pronunciation units is the same as the predetermined number for the corresponding first pronunciation unit. In another embodiment, the predetermined number for each of the second pronunciation units can be set differently from the predetermined number for the corresponding first pronunciation unit. In this embodiment, the first pronunciation unit "參加畢業典禮" is divided into two second pronunciation "參加" and "畢業典禮", and 280 available candidates for "參加" and 56 available candidates for "畢業典禮" are found in the first language model database LMD1, respectively. For example, in this embodiment, the predetermined number of available candidates for each of the second pronunciation units "參加" and "畢業典禮" is ten. That means, the number of available candidates corresponding to each of the second pronunciation units "參加" and "畢業典禮" is more than the corresponding predetermined number, and then step S243 is consequently executed. For a better speech effect, the first pronunciation unit is further divided into shorter second pronunciation units until enough available candidates are found in the corresponding language database.

Figure 5:
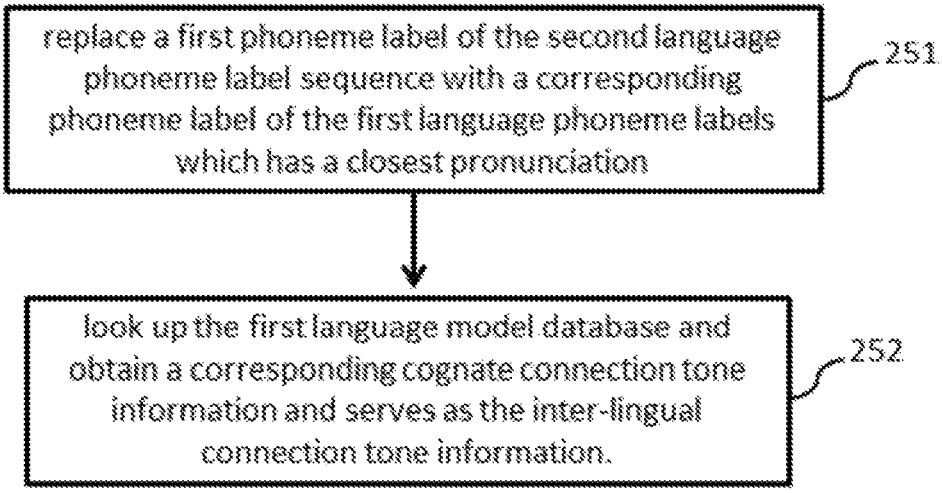
FIG. 5 is a flowchart of step S250 in accordance with an embodiment.

As shown in FIG. 5, the step S250 of producing inter-lingual connection tone information at a boundary between every two immediately adjacent phoneme label sequences further includes a subset of steps in an embodiment. The connection relationships between the phoneme labels of the pronunciation unit of a same language are stored in the language model databases LMD1 and LMD2. Taking the multi-lingual phoneme label sequence [M04 M29 M09 M25 E19 E13 E37 E01 E40 M08 M29 M41 M44] for the text message "放個Jason Mraz來聽" as an example again, the cognate connection tone information for connecting [M04 M29] is stored in the Mandarin model database LMD1, which is represented as L[M04, M29], the cognate connection tone information for [M29 M09] is represented as L[M29, M09], and so on. The cognate connection tone information for any two adjacent phoneme labels of Mandarin is stored in the language model database LMD1. In an embodiment, the cognate connection tone information for the adjacent phoneme labels [E19 E13] is also pre-stored in the English model database LMD2, and so on.

Since each of the language model databases LMD1 and LMD2 stores information of the same language information, respectively, the inter-lingual connection tone information across two languages for the multi-lingual phoneme label sequence [M04 M29 M09 M25 E19 E13 E37 E01 E40 M08 M29 M41 M44] (such as the inter-lingual connection tone information for [M25 E19] and the connection tone information for [E40 M08]) will not be found in conventional TTS method.

The connection tone information between each phoneme label provides the fluency, the consistency, and the consecutiveness of the pronunciation. Therefore, in an embodiment, the processor 160 generates inter-lingual connection tone information at a boundary of any two phoneme labels between two different languages according the step S250, which is illustrated in detail hereinafter.

FIG. 5 is a flow chart showing a method for producing the inter-lingual connection tone information at a boundary between the first language and the second language in an embodiment. As shown in FIG. 5, the step S250 further includes steps S251-S252.

In step S251 of FIG. 5, the processor replaces a first phoneme label of the at least one second language phoneme label sequence with a corresponding phoneme label of the first language phoneme labels which has a closest pronunciation to the first phoneme label of the at least one second language phoneme label sequence.

In an embodiment, in the multi-lingual text message "放個 Jason Mraz來聽", the first boundary between the first language and the second language is the boundary between "個" and "Jason". In this embodiment. Mandarin is the first language, English is the second language, and the Mandarin text "個" (corresponding to the phoneme labels [M09 M25]) appears in front of the English text "Jason" (corresponding to the phoneme labels [E19 E13]). That is, the first boundary at the last phoneme label of the language section of the first language and the first phoneme label of the language section of the second language, in the embodiment, is between the phoneme labels [M25] and [E19].

According to step S251, the first phoneme label [E19] in the language section of the second language (English in the embodiment) is replaced by a phoneme label in the first language (Mandarin in the embodiment) with the closest pronunciation. In an embodiment, the phoneme "Ja" (corresponding to the phoneme label [E19]) in English is replaced with the phoneme "ㄐ" (Pronounced as "Ji") (corresponding to the phoneme label [M12]) in Mandarin, in the embodiment, the phoneme label [E19] of the phoneme "Ja" in English is replaced with a phoneme label [M12] of the phoneme "ㄐ" in Mandarin.

Furthermore, in the same sample text, the second cross language boundary is the boundary between "Mraz" (corresponding to the phoneme labels [E37 E01 E40]) and "來" (corresponding to the phoneme labels [M08 M29]). That is, the second boundary between the last phoneme label of the language Section of the second language and the first phoneme label of the language section of the first language, in this embodiment, is between the phoneme labels [E40] and [M08]. Then, the phoneme label [M08] of the phoneme "來" in Mandarin is replaced with a phoneme label [E21] of the phoneme "le" in English, which is the closest pronunciation to the phoneme label [M08] of the phoneme "來".

Then, in step S252, the processor 160 looks up the first language model database LDM1 using the corresponding phoneme label of the first language phoneme labels thereby obtaining a corresponding cognate connection tone information of the first language model database LDM1 between a last phoneme label of the at least one first language phoneme label sequence and the corresponding phoneme label of the first language phoneme labels, wherein the corresponding cognate connection tone information of the first language model database LMD1 serves as the inter-lingual connection tone information at the boundary between the one of the at least one first language phoneme label sequence and the one of the at least one second language phoneme label sequence.

Specifically, in the above embodiment with the first boundary, the cognate connection tone information L[M25 M12] is found in the first language model database LMD1 of the first language according to the last phoneme label of the first language at the first boundary and the replacing phoneme label [M25 M12], Then, the cognate connection tone information L[M25 M12] is regarded as the inter-lingual connection tone information at the first boundary. For the second boundary, the cognate connection tone information [E40 E21] can be found in the second language model database LMD2 according to the last phoneme label of the second language at the second boundary and the closest replacing phoneme label [E40 E21]. Then, the cognate connection tone information L[E40 E21] is regarded as the inter-lingual connection tone information at the second boundary.

Figure 6B:
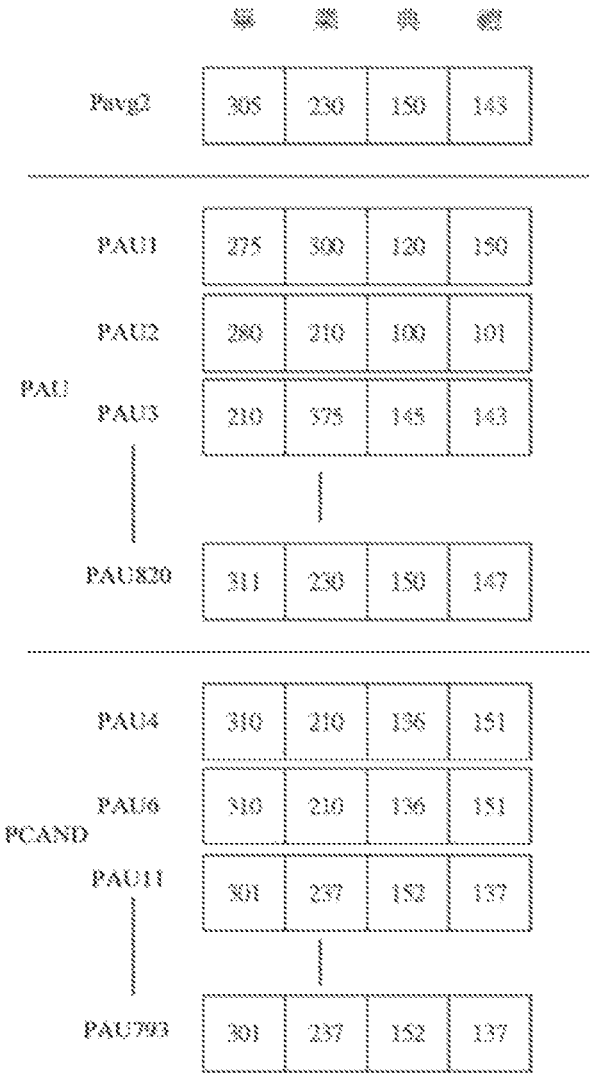

The way of calculating available candidates of the audio frequency data is illustrated accompanying FIGS. 6A and 6B in an embodiment.

As shown in FIG. 6A, in the embodiment, the first pronunciation unit is "參 加畢業典禮", and the pitch, the tempo and the timbre of each character corresponding to the first pronunciation unit "參加畢業典禮" are searched in the first language model database LMD1. The pitch includes, but not limited to, the frequency of phonation, the tempo includes, but not limited to, duration, speed, interval, and rhythm of the pronunciation, and the timbre includes, but not limited to, pronunciation quality, mouthing shapes, and pronunciation positions. FIGS. 6A and 6B are schematic diagrams showing that the pitch is compared to a benchmark average value according to an embodiment.

In the embodiment, curves of the pitch and duration of the tempo of a pronunciation unit are represented by a one-dimensional Gaussian model, respectively. In the embodiment, the one-dimensional Gaussian model for the pitch is a statistical distribution of the pronunciation unit under different frequencies. The one-dimensional Gaussian model for the duration is a statistical distribution of the pronunciation unit under different time durations (such millisecond, ms).

In the embodiment, the mouthing shape representing the timbre is established by multiple Gaussian mixture models. In an embodiment, the Gaussian mixture models are established by a Speaker Adaptation method to record the mouthing shapes representing the timbre, and then relative reliable mouthing shapes are established corresponding to the input text message. The Speaker Adaptation technology includes following steps: establishing a general module for all phonemes of one language according to pronunciation data of different speakers of this language; after the general module for all phonemes of this language is established, extracting a mouthing shape parameter of the required pronunciation from a recorded mixed-language file; moving the general modules of the phonemes to the sample of extracting the mouthing shape parameter, and the modules after moved are adapted models. Detailed steps and the principle of Speaker Adaptation technology are disclosed in "Speaker Verification Using Adapted Gaussian Mixture Models" on the year of 2000 in the journal "Digital Signal Processing" by Reynolds, Douglas A. However, the way of establishing the mouthing shape is not limited to the Speaker Adaptation technology.

In the embodiment, a benchmark average frequency Pavg1 of all pitches for the first pronunciation unit "參加畢業典禮" in the first language model database LMD1 is obtained. In the embodiment, the average frequencies of the six Chinese characters are 100 Hz, 146 Hz, 305 Hz, 230 Hz, 150 Hz, and 143 Hz, respectively. This group of the benchmark average frequency Pavg1 is used as the target audio frequency data, which is the reference in the subsequent selection.

Then, 168 groups of the pitch frequency data PAU of the first pronunciation unit "參加畢業典禮" are found in the first language model database LMD1, as showed in FIG. 6A, PAU1-PAU168. In an embodiment, the frequency difference between the selected group of pitch frequency data and the target audio frequency (that is, the benchmark average frequency Pavg1) is set to be within a predetermined range, 20% of the benchmark average frequency Pavg1. In the embodiment, the predetermined ranges of the target audio frequency data of the six Chinese characters are 100 HZ±20%, 100 Hz±20%, 146 Hz±20%, 305 Hz±20%, 230 Hz±20%, 150 Hz±20%, and 143 Hz±20%. The group with all the six Chinese characters having audio frequency data within the predetermined range will be the candidates (PCAND). For example, in the first group of pitch frequency data PAU1, the frequencies of the six Chinese characters are 175 Hz, 179 Hz, 275 Hz, 300 Hz, 120 Hz, and 150 Hz in sequence, which will be outside of the predetermined range, 20% of the benchmark average Frequency Pavg1. In fact, among the 168 PAU groups, only two available candidate frequency data, PAU63 and PAU103 are within the determined range. However, assuming that the predetermined number of the first pronunciation unit is 10, the number of available candidates (i.e., 2) (PCAND: PAU63 and PAU103) is not equal to or more than the predetermined number (i.e., 10). Therefore, the first pronunciation unit needs to be divided into a plurality of second pronunciation units that are shorter than the first pronunciation unit for more candidates.

The first pronunciation unit "參加畢業典禮" is then divided into two second pronunciation units, "參加" and "畢業典禮". One of the second pronunciation units, "畢業典禮", is taken as an example for more explanation. As showed in FIG. 6B, in an embodiment, the pitch average frequency Pavg2 of the second pronunciation unit, "畢 業典禮", is obtained in the first language model database LMD1. In an embodiment, the average frequencies of the second pronunciation unit "畢業典禮" are 305 Hz, 230 Hz, 150 Hz, and 143 Hz in sequence. The group of the benchmark average frequency Pavg2 is the reference in the subsequent candidates' determination.

Then, the pitch frequency data PAU that correspond to the second pronunciation unit "畢業典禮" are searched in the first language model database LMD1, and 820 groups, PAU1-PAU820, are matched. In an embodiment, in the first group of pitch frequency data PAU1, the frequencies of the four Chinese characters are 275 Hz, 300 Hz, 120 Hz, and 150 Hz in sequence. Then, the pitch frequency data is determined from the groups of pitch frequency data PAU1-PAU 820 and the audio frequency data is, the benchmark average frequency Pavg 2) is assumed to be within a predetermined range (e.g., 20% of the benchmark average frequency Pavg 2). In the embodiment, the number of available candidate frequency data PCAND whose pitch frequency data is within the predetermined range is 340. The number of available candidates for the target audio frequency data is therefore enough, and the length of the second pronunciation unit is proper. Therefore, it is not necessary to divide the second pronunciation unit further into shorter pronunciation units. The range above or below the benchmark average frequency is adjustable, which is not limited to the range 20%.

In the embodiment in FIGS. 6A and 6B, available candidate audio frequency data is selected according to the pitch frequency data. In another embodiment, the available candidate audio frequency data is selected according to a combination of a weigh of the pitch, the tempo, and the timbre.

In an embodiment, the target audio frequency data AUavg is represented as:

$$AUavg=\alpha Pavg+\beta Tavg+\gamma Favg$$

Wherein Pavg represents an average frequency of the pitch, Tavg represents an average duration of the tempo, Favg represents an average mouthing shape of the timbre. In an embodiment, the mouthing shape is represented by a multidimensional matrix. In an embodiment, the mouthing shape is represented by a Mel-frequency cepstral coefficient (MFCC). α, β, and γ represent the weight of Pavg, Tavg, and Favg, respectively. Each of the value of α, β, and γ larger than 0, and the sum of α, β, and γ is 1. In an embodiment, available candidate audio frequency data is determined according to the target sound information AUavg and the result with the weight on the pitch, the tempo, and the timbre of the audio frequency data in the language model database LMD1.

Figure 7:
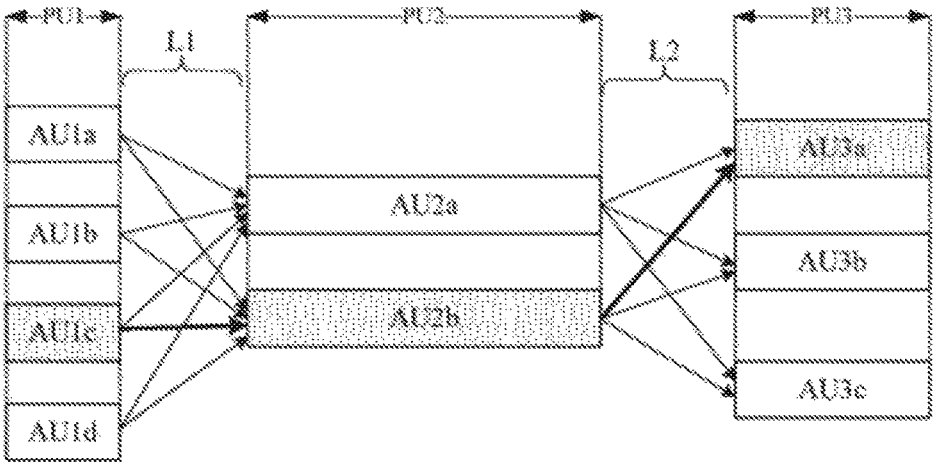
FIG. 7 is a schematic diagram showing the determination of connecting paths of the pronunciation units in accordance with an embodiment.

FIG. 7 is a schematic diagram showing the determination of connecting paths of the pronunciation units in an embodiment.

As shown in FIG. 7, in an embodiment, the text message is finally separated in to a pronunciation unit PU1 (such as a Chinese character), a pronunciation unit PU2 (such as a word), and a pronunciation unit PU3 (such as a phase). In the embodiment, four available candidate audio frequency data AU1*a*-AU1*d* corresponding to the pronunciation unit PU1 are obtained in the language model databases LMD1 and LMD2 two available candidate audio frequency data AU2*a*-AU2*b* corresponding to the pronunciation unit PU2 are obtained in the language model databases LMD1 and LMD2; and three available candidate audio frequency data AU3*a*-AU3*c* corresponding to the pronunciation unit PU3 are obtained in the language model databases LMD1 and LMD2.

Connecting paths L1 from available candidate audio frequency data AU2*a* and AU2*b* to available candidate audio frequency data AU1*a*-AU1*d* are obtained in the language model databases LMD1 and LMD2, and connecting paths L2 from available candidate audio frequency data AU2*a* and AU2*b* to available candidate audio frequency data AU3*a*-AU3*c* are obtained in the language model databases LMD1 and LMD2.

Each of available candidate paths includes a fluency cost, and each of the connecting paths includes a fluency cost. In step S254, a connecting path with a minimum fluency cost is selected from different combinations of the connecting paths L1 and L2 according to the sum of the fluency cost of the three pronunciation units PU1-PU3 and the fluency cost of the connecting paths L1 and L2. As a result, the pronunciation of the selected connecting path is most fluent.

The formula of calculating the minimum fluency cost is as follows.

Cost=α·all candidate audio frequency data of each of the pronunciation units, $C_{Target}(U_i^j)$+β·all candidate audio frequency data of each two adjacent pronunciation units, $C_{Spectrum}(U_i^j, U_{i+1}^k)$+γ·all candidate audio frequency data of each two adjacent pronunciation units, $C_{Pitch}(U_i^j, U_{i+1}^k)$+δ·all candidate audio frequency data of each two adjacent pronunciation units, $C_{Duration}(U_i^j, U_{i+1}^k)$+ϵ·all candidate audio frequency data of each two adjacent pronunciation units, $C_{Intensity}(U_i^j, U_{i+1}^k)$ Wherein represents all available candidate audio frequency data of each of the pronunciation units, $U_{i+1}^k$ represents all available candidate audio frequency data of an adjacent pronunciation unit.

The sum fluency cost equals to the sum of the target cost value (such as $C_{Target}(U_i^j)$ in the following formula) of available candidate audio frequency data of all pronunciation units, the spectrum cost value (such as $C_{Spectrum}(U_i^j, U_{i+1}^k)$) of available candidate audio frequency data between the two adjacent pronunciation units, the pitch cost value (such as $C_{Pitch}(U_i^j, U_{i+1}^k)$) of available candidate audio frequency data between the two adjacent pronunciation units, the tempo cost value (such as $C_{Duration}(U_i^j, U_{i+1}^k)$) of available candidate audio frequency data between the two adjacent pronunciation units, and the intensity cost value such as $C_{Intensity}(U_i^j, U_{i+1}^k)$) of available candidate audio frequency data between the two adjacent pronunciation units. In the following formula, α, β, γ, δ, and ϵ represent the weight of the target cost value, the spectrum cost value, the pitch cost value, the tempo cost value, and the intensity cost value, respectively. The fluency cost at different combinations along the path L1 and L2 is compared, and then the sum of the fluency cost with the minimum value is selected as the final sound information.

The fluency cost at each path selection is calculated according to the above formula, and the fluency cost with the lowest fluency cost is obtained. In an embodiment, the fluency cost of the path from available candidate audio frequency data AU1*c* through available candidate audio frequency data AU2*b* to available candidate audio frequency data AU3*a* is minimum, and then the available candidate audio frequency data AU1*c*, the available candidate audio frequency data AU2*b*, and the available candidate audio frequency data AU3*a* at the path is selected as the final audio frequency data in the text-to-speech method.

Then, according to step S260 in FIG. 2, the processor 160 generates the multi-lingual voice message by arranging and combining the audio frequency data (such as the audio frequency data AU1*c*, AU2*b*, and AU3*a*) of the pronunciation units. And the multi-lingual voice message is output by a broadcasting device 140 as step S270 in FIG. 2, and then the sound output in the TTS method 200 is complete. In the embodiment, the broadcasting device 140 is, but not limited to, a loudspeaker, and/or a handset.

In the embodiment, each of the language model databases LMD1 and LMD2 is pre-established via a training program. In an embodiment, the TTS method 200 further includes a training program for establishing and training the language model databases LMD1 and LMD2.

As shown in FIG. 1, the multi-lingual speech synthesizer 100 further includes a voice receiving module 180. In the embodiment, the voice receiving module 180 is built in the multi-lingual speech synthesizer 100, or independently exists outside the multi-lingual speech synthesizer 100. In an embodiment, the voice receiving module 180 is, but not limited to, a microphone or a sound recorder.

In an embodiment, the voice receiving module 180 samples at least a training voice to execute the training program for each of the language model databases LMD1 and LMD2. The generated language model databases LMD1 and LMD2 after trained are provided to the multi-lingual speech synthesizer 100.

Figure 8:
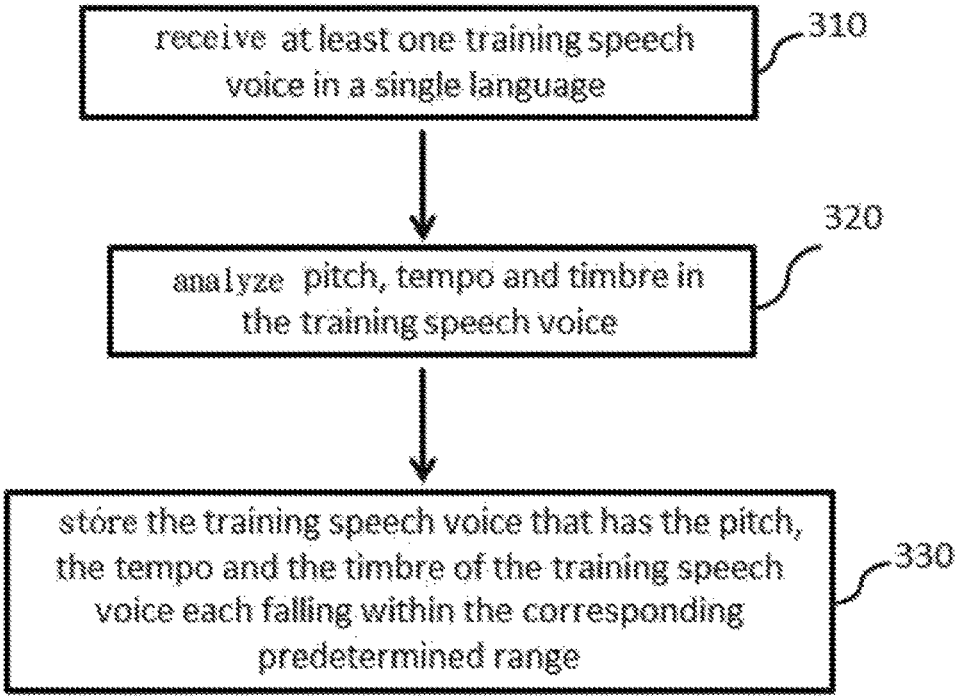
FIG. 8 is a flowchart showing a training method of a training program of the TTS method 200 in accordance with an embodiment.
Figure 9A:
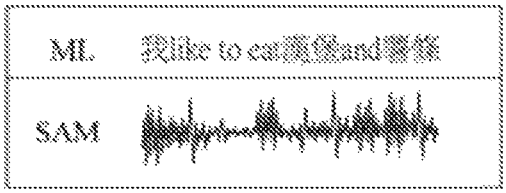
FIGS. 9A-9C show a training voice ML, voice samples SAM and the pitch, the tempo and the timbre of a mixed language after analyzing different languages in accordance with an embodiment.
Figure 9B:
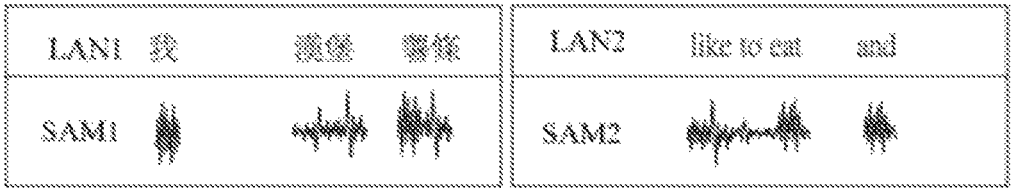
Figure 9C:
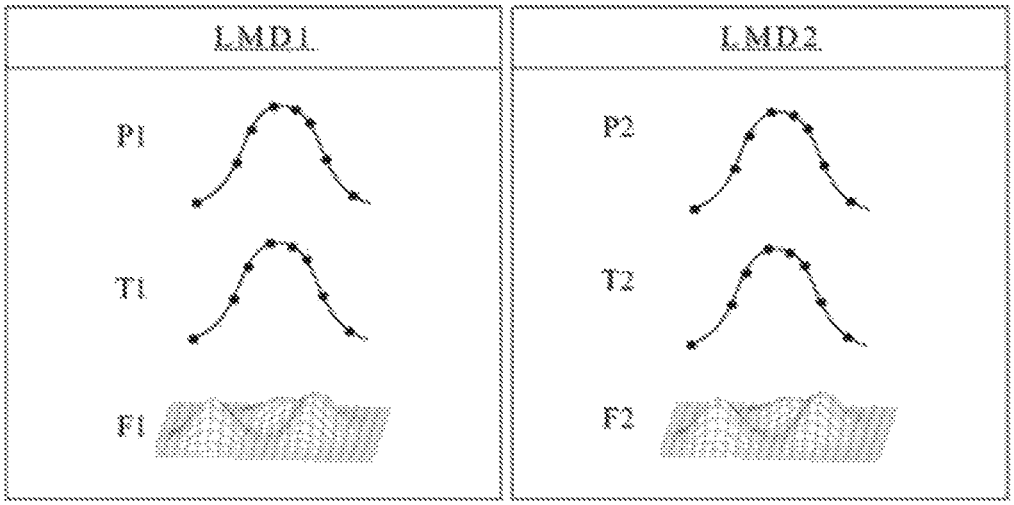

FIG. 8 is a flow chart showing a training method of a training program of the TTS method 200 according to an embodiment. Referring to FIGS. 8 and 9A-9C, in the training program as showed in FIG. 8, in step S310, the voice receiving module 180 receives at least one training speech voice in a single language. FIGS. 9A-9C illustrate a schematic diagram showing a training voice ML, voice samples SAM and the pitch, the tempo and the timbre of a mixed language after analyzing different languages. In the embodiment, the pitch includes, but not limited to, frequency of pronunciation, the tempo includes, but not limited to, duration, speed, interval, and rhythm of the pronunciation, and the timbre, but not limited to, includes pronunciation quality, mouthing shapes (such as MFCC), and pronunciation positions.

In an embodiment, as shown in FIG. 9A, the multi-lingual voice sample SAM for the training voice ML is obtained from a person speaking Mandarin as a native language, and the person speaking Mandarin as the native language can speak Mandarin and English fluently. Then the pronunciation blended with Mandarin and English is obtained from the person, so that the transition between Mandarin and English is smooth. Similarly, a person speaking English as a native language and speaking Mandarin and English fluently can also be chosen for the training.

In an embodiment, a training voice only includes a first voice sample of Mandarin and a second voice sample of English, and the two voice samples are recorded by a person speaking Mandarin as a native language and a person speaking English as a native language, respectively. Then, in step S320, the pitch, the tempo, and the timbre of the two different languages in the training voice samples are analyzed. As shown in FIG. 9B, the mixed language training voice ML in FIG. 9A is separated into the voice sample SAM1 of the first language LAN1 and the voice sample SAM2 of the second language LAN2. Then, as shown in FIG. 9C, the pitch, the tempo, and the timbre of the voice sample SAM1 of the first language LAN1 and the voice sample SAM2 of the second language LAN2 are analyzed to get audio frequency data such as frequency, duration, and the mouthing shapes. The pitch P1, the tempo T1, and the timbre F1 of the voice sample SAM1 are obtained, and the pitch P2, the tempo T2, and the timbre F2 of the voice sample SAM2 are obtained.

The pitch P1 and the pitch P2 are frequency distributions of the voice sample SAM1 and the voice sample SAM2 of all pronunciation units, respectively, the horizontal axis shows deferent frequencies (the unit is Hz), and the vertical axis shows the statistical number of the samples. The tempo T1 and the tempo T2 show the duration distributions of the voice sample SAM1 and the voice sample SAM2 of all pronunciation units, the horizontal axis shows different durations (such as ms), the vertical axis shows the statistical number of the samples. A single sample is a single frame of one phoneme of the voice sample SAM1 or the voice sample SAM2.

In the embodiment, the timbre F1 and the timbre F2 are the mouthing shapes of all pronunciation units of the voice sample SAM1 and the voice sample SAM2, respectively, which are represented by multiple Gaussian mixture models as shown in FIG. 9C, respectively.

The pitch P1, the tempo T1, and the timbre F1 of the voice sample SAM1 of the first language LAN1 are stored in the language model database LMD1, and the pitch P2, and the tempo T2, and the timbre F2 of the voice sample SAM2 of the second language LAN2 are stored in the language model database LMD2.

Next, step S330 is to store the training speech voice that has the pitch, the tempo and the timbre of the training speech voice each falling within a corresponding predetermined range. The pitch, the tempo, or the timbre of each of languages in the training voice is compared to a benchmark range, in an embodiment, the benchmark range is a middle range of voices already-recorded, such as a range above or below two standard deviations by the average of the pitch, the tempo, or the timbre. This step includes excluding training voice samples whose pitch, tempo, or timbre is beyond the benchmark range. Consequently, the pitch, the tempo, or the timbre with extreme values are excluded, or the voice samples with great difference (for example, the pitch of samples from a person with Mandarin as the native language and that of samples from with English as the native language are large) are excluded, and then the consistency of the pitch, the tempo, and the timbre of the two languages are improved.

That is, when the pitch, the tempo, or the timbre of the newly recorded training voice is far beyond the average of the already-recorded data of statistical distribution module (for example, the pitch, the tempo, or the timbre is beyond two standard deviations of the statistical distribution module, or distributes out of the predetermined range 10%-90%), the newly recorded training voice is filtered out, and then the pitch, the tempo, or the timbre (such as pronunciation too shrill or too excited) with a large difference would not affect the consistency of available candidate audio frequency data in the language model databases. At last, the training speech voice is stored in the language model database LMD1 or LMD2 according to the language.

As illustrated in the above embodiments, a multi-lingual text message is converted into a multi-lingual voice message such that the fluency, the consistency, and the consecutiveness of the pronunciation are improved.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A text-to-speech method executed by a processor for processing a multi-lingual text message in a mixture of a first language and a second language into a multi-lingual voice message, cooperated with a first language model database having a plurality of first language phoneme labels and first language cognate connection tone information and a second language model database having a plurality of second language phoneme labels and second language cognate connection tone information, the text-to-speech method comprising:

separating the multi-lingual text message into at least one first language section and at least one second language section;

converting the at least one first language section into at least one first language phoneme label and converting the at least one second language section into at least one second language phoneme label;

looking up the first language model database using the at least one first language phoneme label thereby obtaining at least one first language phoneme label sequence, and looking up the second language database model using the at least one second language phoneme label thereby obtaining at least one second language phoneme label sequence;

assembling the at least one first language phoneme label sequence and at least one second language phoneme label sequence into a multi-lingual phoneme label sequence according to an order of words in the multi-lingual text message;

dividing the multi-lingual phoneme label sequence into a plurality of first pronunciation units, each of the plurality of first pronunciation units is in a single language and includes consecutive phoneme labels of a corresponding one of the at least one first language phoneme label sequence and the at least one second language phoneme label sequence;

for each of the first pronunciation units, determining whether a number of available candidates for a corresponding one of the first pronunciation units in a corresponding one of the first language model database and the second language model database is equal to or more than a predetermined number corresponding to the one of the first pronunciation units;

when the number of available candidates for each of the first pronunciation units in the corresponding one of the first language model database and the second language model database is equal to or more than the corresponding predetermined number, calculating a join cost of each candidate path, wherein each candidate path passes through one of the available candidates of each of the first pronunciation units;

determining a connecting path between every two immediately adjacent first pronunciation units based on the join cost of each candidate path;

producing inter-lingual connection tone information at a boundary between every two immediately adjacent phoneme label sequences;

combining the multi-lingual phoneme label sequence, the first language cognate connection tone information at a boundary between every two immediately adjacent phoneme label of the at least one first language phoneme label sequence, the second language cognate connection tone information at a boundary between every two immediately adjacent phoneme labels of the at least one second language phoneme label sequence, and inter-lingual connection tone information to obtain the multi-lingual voice message, and outputting the multi-lingual voice message.

2. The text-to-speech method of claim 1, wherein every two immediately adjacent phoneme label sequences includes one of the at least one first language phoneme label sequence and one of the at least one second language phoneme label sequence, and when the one of the at least one first language phoneme label sequence is in front of the one of the at least one second language phoneme label sequence, the step of producing the inter-lingual connection tone information comprises:

replacing a first phoneme label of the at least one second language phoneme label sequence with a corresponding phoneme label of the first language phoneme labels which has a closest pronunciation to the first phoneme label of the at least one second language phoneme label sequence; and looking up the first language model database using the corresponding phoneme label of the first language phoneme labels thereby obtaining a corresponding cognate connection tone information of the first language model database between a last phoneme label of the at least one first language phoneme label sequence and the corresponding phoneme label of the first language phoneme labels, wherein the corresponding cognate connection tone information of the first language model database serves as the inter-lingual connection tone information at the boundary between the one of the at least one first language phoneme label sequence and the one of the at least one second language phoneme label sequence.

3. The text-to-speech method of claim 1, wherein each of the first language model database and the second language model database further includes audio frequency data of one or a combination of phrases, words, characters, syllables or phonemes that are formed by consecutive phoneme labels, and the one or the combination of phrases, words, characters, syllables or phonemes that are formed by consecutive phoneme labels is an individual pronunciation unit.

4. The text-to-speech method of claim 1, wherein the step of determining the connecting path between every two immediately adjacent first pronunciation units comprises:

determining a connecting path between a selected one of the available candidates in a front one of two immediately adjacent first pronunciation units and a selected one of the available candidates in a rear one of two immediately adjacent first pronunciation units, wherein the selected one of the available candidates in the front one of two immediately adjacent first pronunciation units and the selected one of the available candidates in the rear one of two immediately adjacent first pronunciation units are both located in one of the candidate paths that has a lowest join cost.

5. The text-to-speech method of claim 1, when the number of available candidates for any one or ones of the first pronunciation units in the corresponding one of the first language model database and the second language model database is less than the corresponding predetermined number, further comprising dividing each of the one or one of the first pronunciation units into a plurality of second pronunciation units, wherein a length of any one of the second pronunciation units is shorter than a length of a corresponding one of the first pronunciation units;

for each of the second pronunciation units, determining whether a number of available candidates for a corresponding one of the second pronunciation units in a corresponding one of the first language model database and the second language model database is equal to or more than a predetermined number corresponding to the one of the second pronunciation units.

6. The text-to-speech method of claim 1, wherein the join cost of each candidate path is a weighted sum of a target cost of each candidate audio frequency data in each of the first pronunciation units, an acoustic spectrum cost of each connection between the candidate audio frequency data in every two immediately adjacent first pronunciation units, a tone cost of each connection between the candidate audio frequency data in every two immediately adjacent first pronunciation units, a pacemaking cost of each connection between the candidate audio frequency data in every two immediately adjacent first pronunciation units, and an intensity cost of each connection between the candidate audio frequency data in every two immediately adjacent first pronunciation units.

7. The text-to-speech method of claim 1, wherein each of the first language model database and the second language model database is established by a training procedure in advance, wherein the training procedure comprises:

receiving at least one training speech voice in a single language;

analyzing pitch, tempo and timbre in the training speech voice;

and storing the training speech voice that has the pitch, the tempo and the timbre of the training speech voice each falling within a corresponding predetermined range.

8. A multi-lingual speech synthesizer for processing a multi-lingual text message in a mixture of a first language and a second language into a multi-lingual voice message, the synthesizer comprising:

a storage device configured to store a first language model database having a plurality of first language phoneme labels and first language cognate connection tone information, and a second language model database having a plurality of second language phoneme labels and second language cognate connection tone information;

a broadcasting device configured to broadcast the multi-lingual voice message;

a processor, connected to the storage device and the broadcasting device, configured to:

separate the multi-lingual text message into at least one first language section and at least one second language section;

convert the at least one first language section into at least one first language phoneme label and converting the at least one second language section into at least one second language phoneme label;

look up the first language model database using the at least one first language phoneme label thereby obtaining at least one first language phoneme label sequence, and look up the second language database model using the at least one second language phoneme label thereby obtaining at least one second language phoneme label sequence;

assemble the at least one first language phoneme label sequence and at least one second language phoneme label sequence into a multi-lingual phoneme label sequence according to an order of words in the multi-lingual text message;

divide the multi-lingual phoneme label sequence into a plurality of first pronunciation units, each of the plurality of first pronunciation units is in a single language and includes consecutive phoneme labels of a corresponding one of the at least one first language phoneme label sequence and the at least one second language phoneme label sequence;

for each of the first pronunciation units, determine whether a number of available candidates for a corresponding one of the first pronunciation units in a corresponding one of the first language model database and the second language model database is equal to or more than a predetermined number corresponding to the one of the first pronunciation units;

when the number of available candidates for each of the first pronunciation units in the corresponding one of the first language model database and the second language model database is equal to or more than the corresponding predetermined number, calculate a join cost of each candidate path, wherein each candidate path passes through one of the available candidates of each of the first pronunciation units;

determine a connecting path between every two immediately adjacent first pronunciation units based on the join cost of each candidate path;

produce inter-lingual connection tone information at a boundary between every two immediately adjacent phoneme label sequences;

combine the multi-lingual phoneme label sequence, the first language cognate connection tone information at a boundary between every two immediately adjacent phoneme label of the at least one first language phoneme label sequence, the second language cognate connection tone information at a boundary between every two immediately adjacent phoneme labels of the at least one second language phoneme label sequence, and inter-lingual connection tone information to obtain the multi-lingual voice message, and output the multi-lingual voice message to the broadcasting device.

9. The multi-lingual speech synthesizer of claim 8, wherein every two immediately adjacent phoneme label sequences includes one of the at least one first language phoneme label sequence and one of the at least one second language phoneme label sequence, and when the one of the at least one first language phoneme label sequence is in front of the one of the at least one second language phoneme label sequence, the processor being producing the inter-lingual connection tone information further configures to:

replace a first phoneme label of the at least one second language phoneme label sequence with a corresponding phoneme label of the first language phoneme labels which has a closest pronunciation to the first phoneme label of the at least one second language phoneme label sequence; and look up the first language model database using the corresponding phoneme label of the first language phoneme labels thereby obtaining a corresponding cognate connection tone information of the first language model database between a last phoneme label of the at least one first language phoneme label sequence and the corresponding phoneme label of the first language phoneme labels, wherein the corresponding cognate connection tone information of the first language model database serves as the inter-lingual connection tone information at the boundary between the one of the at least one first language phoneme label sequence and the one of the at least one second language phoneme label sequence.

10. The multi-lingual speech synthesizer of claim 8, wherein each of the first language model database and the second language model database further includes audio frequency data of one or a combination of phrases, words, characters, syllables or phonemes that are formed by consecutive phoneme labels, and the one or the combination of phrases, words, characters, syllables or phonemes that are formed by consecutive phoneme labels is an individual pronunciation unit.

11. The multi-lingual speech synthesizer of claim 8, wherein when determine the connecting path between every two immediately adjacent first pronunciation units, the processor further configures to:

determine a connecting path between a selected one of the available candidates in a front one of two immediately adjacent first pronunciation units and a selected one of the available candidates in a rear one of two immediately adjacent first pronunciation units, wherein the selected one of the available candidates in the front one of two immediately adjacent first pronunciation units and the selected one of the available candidates in the rear one of two immediately adjacent first pronunciation units are both located in one of the candidate paths that has a lowest join cost.

12. The multi-lingual speech synthesizer of claim 8, when the number of available candidates for any one or ones of the first pronunciation units in the corresponding one of the first language model database and the second language model database is less than the corresponding predetermined number, the processor further configures to:

divide each of the one or ones of the first pronunciation units into a plurality of second pronunciation units, wherein a length of any one of the second pronunciation units is shorter than a length of a corresponding one of the first pronunciation units;

for each of the second pronunciation units, determine whether a number of available candidates for a corresponding one of the second pronunciation units in a corresponding one of the first language model database and the second language model database is equal to or more than a predetermined number corresponding to the one of the second pronunciation units.

13. The multi-lingual speech synthesizer of claim 8, wherein the join cost of each candidate path is a weighted sum of a target cost of each candidate audio frequency data in each of the first pronunciation units, an acoustic spectrum cost of each connection between the candidate audio frequency data in every two immediately adjacent first pronunciation units, a tone cost of each connection between the candidate audio frequency data in every two immediately adjacent first pronunciation units, a pacemaking cost of each connection between the candidate audio frequency data in every two immediately adjacent first pronunciation units, and an intensity cost of each connection between the candidate audio frequency data in every two immediately adjacent first pronunciation units.

14. The multi-lingual speech synthesizer of claim 8, wherein each of the first language model database and the second language model database is established by a training procedure in advance, wherein the training procedure comprises:

receiving at least one training speech voice in a single language;

analyzing pitch, tempo and timbre in the training speech voice; and storing the training speech voice that has the pitch, the tempo and the timbre of the training speech voice each falling within a corresponding predetermined range.

* * * * *